United States Patent [19]

Tanaka

[11] 4,251,999

[45] Feb. 24, 1981

[54] DEFROSTING CONTROL SYSTEM

[75] Inventor: Yasuhiko Tanaka, Osaka, Japan

[73] Assignee: Matsushita Reiki Co., Ltd., Osaka, Japan

[21] Appl. No.: 27,890

[22] Filed: Apr. 6, 1979

[30] Foreign Application Priority Data

May 19, 1978 [JP] Japan ..... 53-60435

[51] Int. Cl.[3] ..... F25D 21/06; G05D 23/32

[52] U.S. Cl. ..... 62/155; 62/157; 62/176 A; 62/234

[58] Field of Search ..... 328/3, 39; 331/74; 62/155, 176 A, 157, 234; 236/46 F

[56] References Cited

U.S. PATENT DOCUMENTS

| | | | |
|---|---|---|---|
| 3,460,352 | 8/1969 | Lorenz | 62/155 X |
| 3,759,049 | 9/1973 | Bell et al. | 62/155 X |
| 3,854,915 | 12/1974 | Schulze-Berge et al. | 62/155 |

*Primary Examiner*—William E. Wayner
*Assistant Examiner*—Harry Tanner
*Attorney, Agent, or Firm*—Burgess, Ryan and Wayne

[57] ABSTRACT

A system wherein the pulses from a pulse source or the pulses divided or doubled in frequency are selected depending upon environmental conditions, and the number of selected pulses is counted so that an electronic counter generates the defrosting instruction.

11 Claims, 8 Drawing Figures

DEFROSTING CONTROL SYSTEM

BACKGROUND OF THE INVENTION

The present invention relates to a heating device such as an electric heater for removing frost and ice produced in an evaporator of an evaporation apparatus such as an evaporator or the like or in an outdoor heat exchanger of a heat pump.

In the prior art evaporation apparatus such as evaporators, frost produced on an evaporator is defrosted by means of an electric heater, a hot gas or the like in response to the defrosting instruction generated when the operation time of a compressor is integrated to a predetermined time period (for instance 8 hours). As compared with a defrosting system of the type wherein defrosting operations are periodically carried out at a predetermined time interval independently of the operation cycles of the compressor, the defrosting system described above is more efficient because useless defrosting operations are less. However, an operation integration time is set depending upon a maximum amount of frost in the case of high environmental temperatures (humidity) in summer so that in the case of low environmental temperatures (for instance 10° C.) in winter, at a stage at which the operation integration time of the compressor exceeds 8 hours, an actual amount of frost is less so that when the environmental temperature is maintained almost unchanged, there will often be no hindrance even when the defrosting operation is started after 8 hours. In the case of the heat pump, the period of the defrosting operations of an outdoor heat exchanger which is set to a lowest temperature at which the operation of the heat pump is possible is too short at relatively high environmental temperatures. In this period, there will be no hindrance even when the number of defrosting operations is reduced.

SUMMARY OF THE INVENTION

Accordingly, one of the objects of the present invention is to provide a defrosting control system wherein in the case of integrating by an electronic counter the operation time of a compressor, useless defrosting operations may be reduced by selecting the number of pulses applied to the electronic counter depending upon environmental temperatures or humidity, thereby eliminating the waste of power consumption.

Another object of the present invention is to provide a defrosting control system wherein in a defrosting device utilizing an electronic counter, the contents which have been counted are erased in the case of disconnection from a power source or interruption of the power supply, but regardless of the environmental temperature or humidity, the integration by the electronic counter is forced to be set to a predetermined time so that the increase in amount of frost due to an extreme increase in integration time may be prevented.

Figure 1:
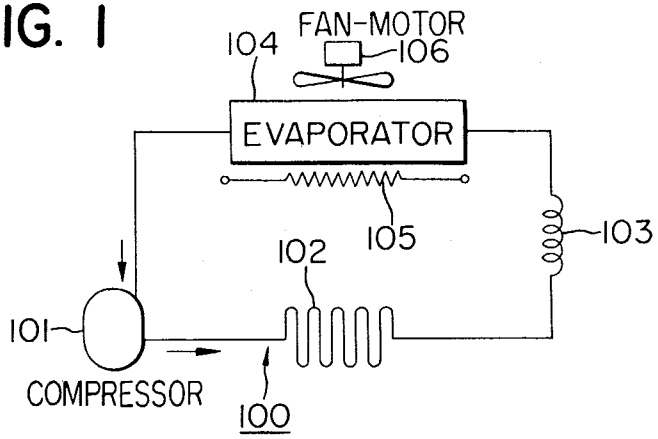
FIG. 1 is a schematic system circuit diagram of an evaporation apparatus used in a general type evaporator or the like to which may be applied the present invention.
Figure 2:
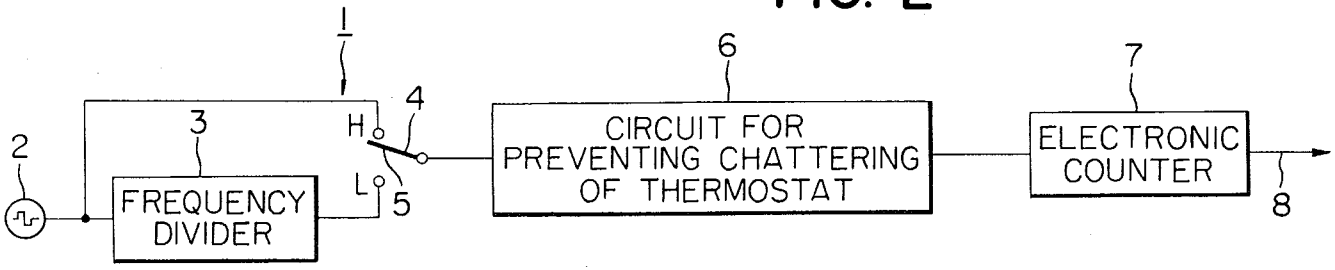
FIG. 2 is a block diagram of a defrosting control system for the evaporation apparatus which is shown in FIG. 1 and to which is applied the present invention.

DESCRIPTION OF THE PREFERRED EMBODIMENTS:

An evaporation device 100 shown in FIG. 1 shows a coolant circuit used in a general type evaporator. 101 is a compressor; 102, a condenser for condensing a cooling medium that is compressed; 103, a capillary tube for decompressing the liquid coolant in the condenser; 104, an evaporator for cooling an evaporation space and the evaporator 104 is cooled by a fan-motor 106. A heating device 105 is disposed in heat exchange relationship with the evaporator so as to melt and remove frost, ice or the like that are produced in the evaporator. FIG. 2 is an embodiment of a defrosting control device in accordance with the present invention which gives the defrosting instruction for activating the heating device 105. 2 is a pulse source which is obtained by stepping down a commercial voltage and then half-wave rectifying it and is so designed and constructed so as to generate the pulse in coacting with the operation of the compressor 101 which makes ON and OFF operations under the control of a thermostat 107 in the evaporator.

Figure 3:
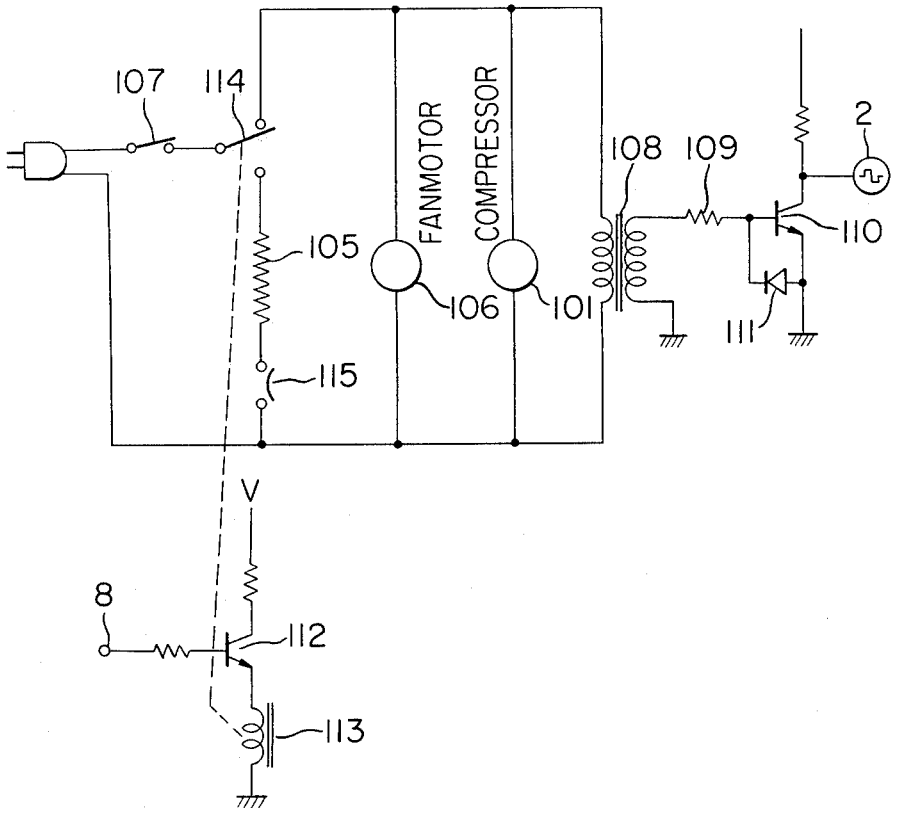
FIG. 3 is a circuit diagram of a defrosting control system of the present invention applied to the evaporation apparatus shown in FIG. 1.

That is, as shown in FIG. 3, the primary winding of a step-down transformer 108 is connected in parallel with the compressor 101 and the secondary winding is connected through a resistor 109 to the base of a transistor 110. A diode 111 is interconnected between the base and emitter and is given from the collector to the source 2. 3 is a frequency divider for dividing the frequency of the pulse source 2 into for instance ½; 4, is a thermostat for sensing the delayed environmental temperature of the evaporator 100 and switches a movable contact 5 to a high temperature contact H when the sensed temperature is higher than a predetermined level (for instance 15° C.) but switches the contact 5 to a low temperature contact L when the sensed temperature is less than a predetermined temperature. 6 is a circuit for preventing chattering of the thermostat 4; 7, an electronic counter comprising a plurality of flip-flops; and 8, the output terminal of the electronic counter 7, the signal derived therefrom being used as the defrosting instruction.

In order to activate the heating body 105 in response to this signal, a relay coil 113, which is connected to the emitter of a switching transistor 112 as shown in FIG. 3, is energized so as to switch a relay contact 114 from the evaporation operation side to the defrosting side, thereby energizing the heating body 105. 115 is a thermostat for detecting the completion of defrosting operation which is turned off at a predetermined temperature (for instance 10° C.).

Next the mode of operation of the system with the above described construction will be explained. In the case of a high environmental temperature the contact 5 is brought into contact with the high-temperature contact H. Depending upon the operation of the compressor, a pulse train at 60 Hz becomes the input to the electronic counter 7. In the case of a low environmental temperature, the contact 5 is switched to the low temperature contact L so that the pulse train whose frequency is 30 Hz as the result of the frequency division effected by the frequency divider becomes the input to the electronic counter 7. When the electronic counter 7 accomplishes the counting of a predetermined number of counts, the defrosting signal r is generated so that the defrosting instruction is derived from the output terminal 8 of the electronic counter 7.

Therefore when high temperature continues as in summer, the defrosting instruction is obtained after an integration of 8 hours. On the other hand, when low temperatures continue as in winter, the defrosting instruction is obtained after the integration of 16 hours. Under the condition that high temperature and low temperature alternate, the defrosting instruction is derived at an integration time between 8 and 16 hours. When temperatures higher than a predetermined temperature are frequent depending upon the ratio between temperatures above a predetermined temperature and temperatures lower than a predetermined temperature, the defrosting instruction is derived earlier, but when temperatures lower than a predetermined temperature are many, it is derived belatedly.

Figure 4:
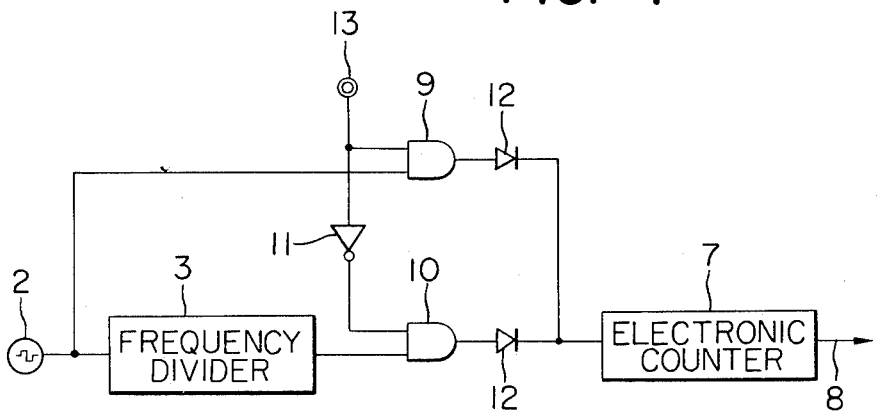
FIG. 4 is a block diagram of another embodiment of the present invention.

Next FIG. 4 which is another embodiment of the present invention will be described. In this figure same reference numerals are used to designate similar parts. This circuit contemplates the non-contactization of the contacts of the thermostat 4 shown in FIG. 4. 2, 3 and 7 are the pulse source, the frequency divider and the electronic counter, respectively 9 and 10 are AND gates; 11, a NAND gate; 12, a reverse-current blocking diode. To one inputs 13 of AND gates 9 and 10 are applied from an input terminal 13 a signal from a temperature sensor which senses an environmental temperature with an element such as a thermistor or the like and generates ON and OFF signals. Applied to the other input are the pulse directly from the pulse source 2 and the frequency divider 3. In order that the embodiment shown in FIG. 4 may accomplish the same operation as the embodiment shown in FIG. 1, it suffices to apply the signal "1" when an environmental temperature is higher than a predetermined temperature and "0" when it is lower than the latter.

That is, in the case of an environmental temperature higher than a predetermined level, the signal "1" is applied to the input terminal 13 while the signal "1" is applied to one input of AND gate 9 while the signal "0" is applied to one input of AND gate 10 because of NAND gate 11. As a result, the pulse of 60 Hz from the pulse source 2 passes through the AND gate 9 and the diode 12 and is applied to the electronic counter 7. When an environmental temperature is less than a predetermined level, the signal "0" is applied to the input terminal 13 so that the signal "0" is applied to one input of AND gate 9 while the signal "1" is applied to one input of AND gate 10 because of the NAND gate 11. As a result, the pulse of 30 Hz which is derived from the pulse source 2 through the frequency divider 3 passes through the AND gate 10 and the diode 12 and is applied to the electronic counter 7. Therefore when an environmental temperature is higher than a predetermined level, the electronic counter 7 effects the count of 8 hours; when an environmental temperature is lower than a predetermined level, it effects the count of 16 hours; and when environmental temperatures repeatedly rise above and lower below a predetermined level, it counts between 8 and 16 hours. The defrosting signal is generated from the counter output terminal 8 so that the defrosting instruction is derived.

Figure 5:
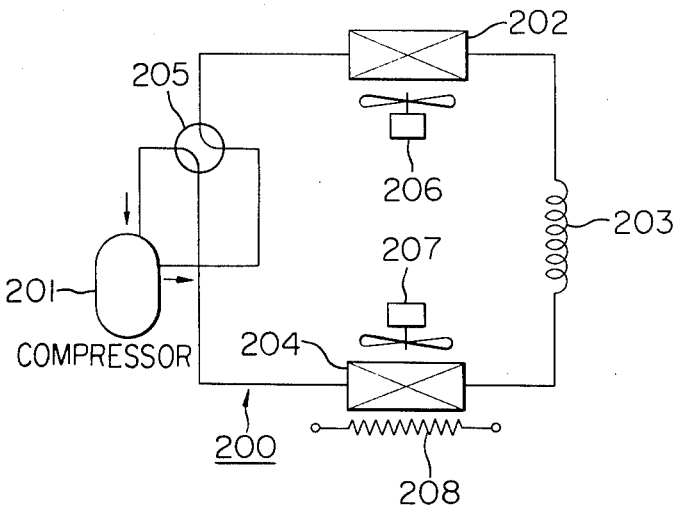
FIG. 5 is a schematic system diagram of a general type heat pump to which is applied a defrosting control system in accordance with the present invention.

FIG. 5 shows a circuit of a general type heat pump 200 system. 201 is a compressor; 202, a heat exchanger inside a room; 203, a capillary tube; 204, a heat exchanger outside of the room; 205, a four-way reversing valve for changing the direction of coolant medium flow. In the heat pump of the type described above, frost produced in the outdoor heat exchanger 204 is effected by temporarily switching from heating operation to cooling operation. However, an auxiliary electric heater 208 may be additionally installed in the outdoor heat exchanger 204. Therefore the defrosting instruction by the defrosting control device is effected by the energization of the four-way reversing valve 205 or the auxiliary electric heater 208.

Figure 6:
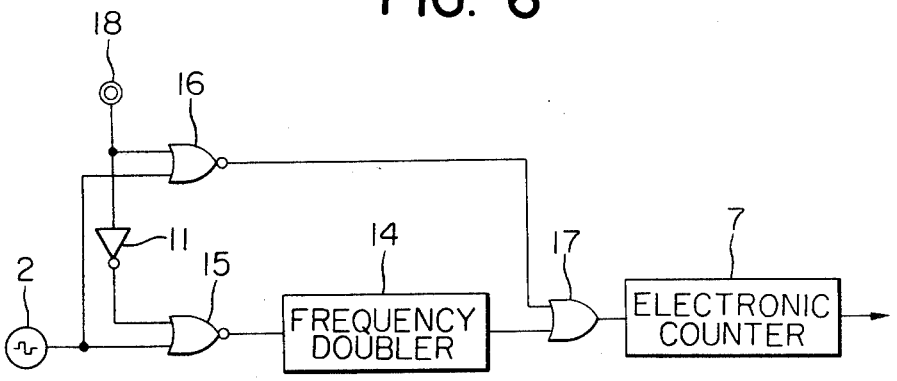
FIG. 6 is a block diagram of a defrosting control system for the heat pump which is shown in FIG. 5 and to which is applied the present invention.

A yet another embodiment of the present invention shown in FIG. 6 is a defrosting control device for the outdoor heat exchanger 204 of the heat pump 200. In this case, when the environmental temperature is low, the defrosting instruction is generated earlier while in the case of a high environmental temperature, it is generated belatedly.

That is, in FIG. 6 same reference numerals are used to designate parts similar to those shown in FIG. 2 for explanation. 14 is a frequency doubler for doubling the frequency from the pulse source 2; 15 and 16, NOR gates; 17, an OR gate; 18, an input terminal to which is applied the signal "0" from an element such as a thermistor or the like when an environmental temperature is higher than a predetermined level, but to which is applied the signal "1" when an environmental temperature is lower than a predetermined level. This input terminal is connected to one input of NOR gate 16 and to one terminal of NOR gate 15 through the inverter 11. The pulse source 2 is connected to the other input terminals of NOR gates 15 and 16.

With this construction, when an environmental temperature is higher than a predetermined level, the signal "0" is impressed on the input terminal 18 so that the signal "0" is applied to one input of NOR gate 16 while the signal "1" is applied to one input of NOR gate 15. The pulse from the pulse source 2 is applied to the OR gate 17 through the NOR gate 16 and then applied to the electronic counter 7. When an environmental temperature is lower than a predetermined level, the signal "1" is applied to the input terminal 18 so that the signal "1" is applied to one input of NOR gate while the signal "0" is applied to one input of NOR gate 15 because of the inverter 11. The pulse from the pulse source 2 is applied to the frequency doubler 14 through NOR gate 15 so that the number of pulses is increased and is applied through OR gate to the electronic counter 7. In this case, opposed to the embodiments shown in FIGS. 2 and 4, when environmental temperatures below a predetermined level continue, the defrosting instruction is generated by the electronic counter 7 at a predetermined time T of the integration operation time. On the other hand, when environmental temperatures higher than a predetermined level continue, the electronic counter 7 generates the defrosting instruction at 2 T time of the integration operation time. When high and low temperatures alternate, the electronic counter 7 generates the defrosting instruction when the integration time is between T and 2 T. When temperatures higher than a predetermined level are many it is generated belatedly depending upon the ratio between the temperatures above and below a predetermined level and when temperatures lower than a predetermined level are many, it is generated earlier.

In the three embodiments described so far, instead of thermostats, thermistors or the like, humidity sensors may also be used.

Figure 7:
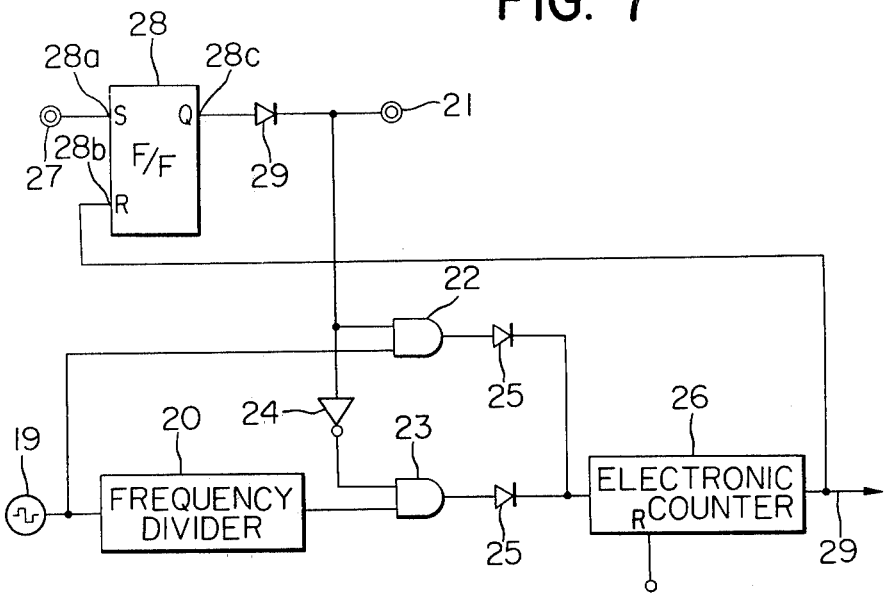
FIG. 7 is a block diagram of a defrosting control system which is an improvement of the device shown in FIG. 4 and is utilized in the evaporation apparatus shown in FIG. 1.

FIG. 7 shows a defrosting control device used in the evaporation apparatus shown in FIG. 1. It is intended to encounter the delay of the defrosting instruction when the contents in the electronic counter 7 cannot be used because of the interruption of power supply. That is, in FIG. 7, 19 is a pulse source obtained by stepping down a commercial voltage and half-wave rectifying and is adapted to generate pulses in response to the operation of the compressor 101. 20 is a frequency divider for obtaining for instance one half of the frequency of the pulse source; 21, an environmental condition input terminal to which is applied, by the detection of an environmental temperature by means of an element such as a thermistor or the like, the signal [1] when the environmental temperature sensed is higher than for instacen 15° C. but the signal [0] when the environmental temperature is lower than 15° C. 22 and 23 are AND gates; 24, an inverter; 25, a reverse current blocking diode; 26, an electronic counter comprising a plurality of flip-flops. 27, a power source application signal input terminal to which is applied the signal [1] only when the power source is thrown. 28 is a flip-flop for memorizing the power source application signal. The power source application signal is applied to a set terminal 28*a* while the output signal from the power counter 26 is applied to a reset terminal 28*b*. Furthermore an output terminal 28*c* is connected through a diode 29 to the environmental condition input terminal 21.

Next the mode of operation of the device with the above construction will be described. When the power source is thrown, the electronic counter 26 is reset first. Thereafter or simultaneously the power source application signal is applied from the power source application signal input terminal 27 to the flip-flop 28, and the signal [1] is continuously generated. Meanwhile, the power source is also applied to the evaporation apparatus 100 shown in FIG. 1 so that the operation of the compressor 101 is started. Since the signal "1" is also applied to the flip-flop 28, the pulse of 60 Hz is applied to the electronic counter 26 through the AND gate 22 regardless of the signal from the environmental condition input terminal 21 being "1" or "0". When the integrated operation time of the compressor 101 becomes 8 hours, the defrosting signal is generated from the counter output terminal 29 of the electronic counter 26. Simultaneously the signal from the electronic counter 26 is applied to the reset terminal 28*b* of the flip-flop 28 so that the latter maintains the [0] output. The maintenance of [0] output is continued from a time when the power source is cut off once till the power source is applied again. As described above, from the time of initial power source throw to the defrosting time, regardless of the environmental condition input terminal 21 receiving [1] or [0], the pulse of 60 Hz is always applied to the electronic counter 26.

As described above, when the cooling operation is started after the power source is applied to the evaporation apparatus 100 shown in FIG. 1, the first defrosting instruction is generated and the defrosting is completed, the pulse input to the electronic counter 26 is controlled by the environmental condition input terminal 21. For instance, as described elsewhere with particular reference to FIG. 2, when high temperatures continue as is in summer, the defrosting instruction is generated at the integration time of 8 hours. When low temperatures continue as do in winter, the defrosting instruction is derived at the integration time of 16 hours. When high and low temperatures alternate, the defrosting instruction is issued at the integration time between 8 and 16 hours. When the temperatures above a predetermined level are many, the defrosting instruction is output earlier depending upon the ratio between temperatures above and below a predetermined level, but when temperatures below a predetermined level are many, it is obtained belatedly.

Therefore when the operation time of the compressor is integrated, the environmental temperature compensation function is added so that efficient defrosting operations may be accomplished and power consumption may be reduced.

The evaporation apparatus 100 is operated in the manner described above. At low temperatures as is in winter, in this operation, the defrosting instruction is derived from the counter output terminal 29 at the integration time of 16 hours. Now it is assumed that a power source plug of the evaporation apparatus 100 is pulled out erroneously from the power source or the supply of power is interrupted at the integration time of 15 hours so that the evaporation apparatus 100 is not energized. As a result, in the case of the defrosting devices shown in FIGS. 2 and 4, the interruption of the energization of the power supply source results in the return to zero of the operation integration time of 15 hours. Thereafter, when the power supply is resumed, the integration of the operation periods is started from zero and at the 16th hour, the defrosting instruction is generated from the defrosting control device. As a result, the defrosting instruction is derived at the 31-st hour which is the sum of the initial 15 hours and the succeeding 16 hours so that it is not preferable because the defrosting operation is carried out at a time point when frost is abnormally adhered.

However, with the defrosting control device of the type shown in FIG. 7, even when the power source of the evaporation apparatus 100 and said device is once stopped and then energized again at the 15-th hour as described above, the signal "1" is applied to the power source application input terminal 27 and is applied to the set terminal 28*a* of the flip-flop 28. As a consequence, regardless of the signal "0" applied to the environmental condition input terminal 21, the pulse of 60 Hz from the pulse source 19 is applied to the electronic counter 26 through the AND gate 22. Therefore even when the operation time of the compressor 101 is integrated from zero in response to the resumption of the power supply, the defrosting instruction is derived at the 8-th hour. As a result, the counter generates the defrosting instruction at the 23-rd hour which is the sum of the initial 15 hours and the succeeding 8 hours so that the defrosting operation can be effected at a time point of a relatively optimum frost adhesion. When, during the integration of the operation time of the evaporation apparatus 100, the power source is cut off once erroneously and then one power source throw is effected for energizing again, the defrosting control device of the type shown in FIG. 2 or 4 generates the defrosting instruction at a longest time of 32 hours which is the sum of the initial 16 hours and the succeeding 16 hours while the defrosting control device of the type shown in FIG. 6 generates the defrosting instruction after 24 hours which is the sum of the initial 16 hours and the succeeding 8 hours.

Figure 8:
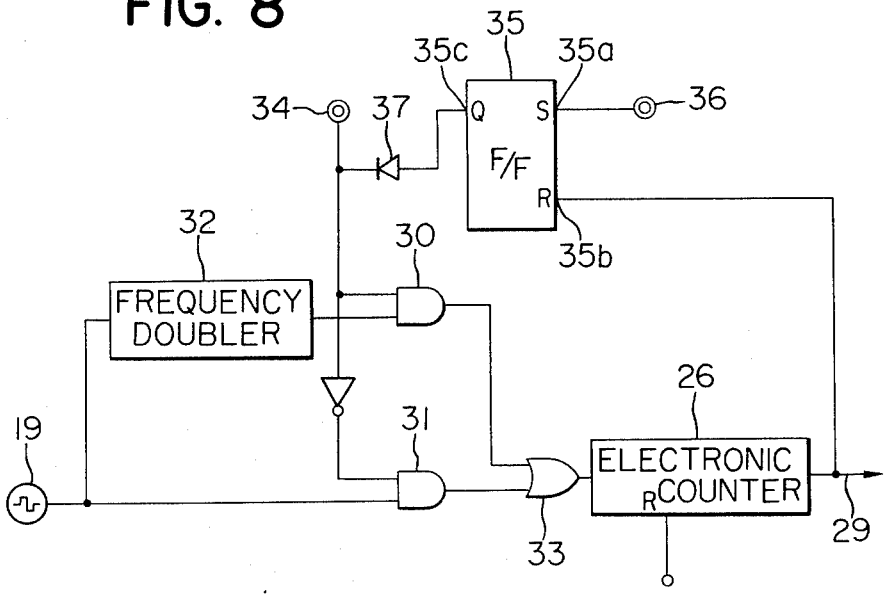
FIG. 8 is a block diagram of a defrosting control system which is an improvement of the device shown in FIG. 6 and which is applied to the heat pump shown in FIG. 5.

FIG. 8 shows a still another embodiment of the present invention which is used for defrosting the air conditioning heat pump shown in FIG. 5. In FIG. 8, 19 is a pulse source; 30 and 31, AND gate; 32, a frequency doubler from the output of which is derived the signal having a frequency twice the frequency of the pulse source 19; 33, an OR gate. 34 is an environmental condition input terminal. In this case, the signal [0] is applied when an environmental temperature is high while the signal [1] is applied when an environmental temperature is low. 35 is a flip-flop. A set terminal 35*a* is connected to a power source application input terminal 36 while a reset terminal 35*b* receives the output signal from the electronic counter 26.

Furthermore, an output terminal 35*c* is connected through a diode 37 to the environmental condition input signal 34. Therefore when the power source is thrown, the signal [1] is derived from the output terminal 35*c* of the flip-flop 35, and the output signal from the AND gate 30 is applied through the frequency doubler 32 regardless of an environmental temperature. As a result, the counting is advanced with the number of pulses twice the frequency of the pulse source 19 and when the integration operation time becomes a predetermined time, the defrosting signal is generated. Therefore the defrosting operation is started, and simultaneously the signal from the counter output terminal 29 of the electronic counter 26 is applied to the reset terminal 35*b* of the flip-flop 35.

Thereafter the count is effected under the control of the environmental condition input terminal. That is, opposed to the embodiment shown in FIG. 7, when low environmental temperatures continue, the defrosting instruction is generated at a predetermined time T of the integration time. When environmental temperatures above a predetermined level continues, the defrosting instruction is generated at 2 T hours of the integration operation time. When high and low temperatures alternate, the defrosting instruction is generated between T and 2 T of the integration time.

It is assumed that an interruption of the power supply occur for instance at a time t which is earlier than 2 T which is a predetermined time after the operation of the heat pump so that the contents in the electronic counter 26 becomes useless. After the power supply has been resumed, the signal "1" is derived from the flip-flop 35 even when the environmental temperature is high so that the signal "0" is applied to the environmental condition input terminal 36. As a consequence, after the power supply has been resumed, the defrosting instruction is generated after T hours so that the defrosting operation is effected after (t+T) hours except the time interval during which the power supply failure continued.

As a result, with the device shown in FIG. 6, there is a fear that the defrosting instruction is generated after (t+T) hours so that the operation time becomes longer. However, with the device shown in FIG. 8, there is no such fear. After at least (t+T) hours, the defrosting operation will be carried out.

In the embodiments described above, a plurality of frequency dividers or frequency doublers may be used so as to further divide the frequency of the pulse source, thereby corresponding to the high, medium and low environmental temperatures.

What is claimed is:

1. A defrosting control system having a pulse source for generating pulses, a pulse number changing means for changing the number of pulses from said pulse source, a pulse selection means for selecting, depending upon environmental conditions, the pulses from said pulse source or the pulses through said pulse number changing means, an electronic counter for counting the number of pulses from said pulse selection means and generating the defrosting instruction, and means responsive to said defrost instruction for performing the defrost operation.

2. A defrosting control system having a pulse source for generating pulses, a frequency divider for effecting the frequency division of the pulses from said pulse source, a pulse selection means for selecting, depending upon environmental conditions, the pulses from said pulse source or the pulses from said frequency divider, an electronic counter for counting the pulses from said pulse selection means and generating the defrosting instruction, and means responsive to said defrost instruction for performing the defrost operation.

3. A defrosting control system having a pulse source for generating pulses, a frequency doubler for doubling the pulses from said pulse source, a pulse selection means for selecting, depending upon an environmental temperature the pulses from said pulse source or the pulses from said frequency doubler, and an electronic counter for counting the number of pulses from said pulse selection means and for generating the defrosting instruction which is applied to an evaporation circuit including a compressor and means responsive to said defrost instruction for performing the defrost operation.

4. A defrosting control system as set forth in claim 2 wherein said pulse selection means is provided with a means which ensures the transmission of the pulses from said pulse source to said electronic counter when a power source is thrown regardless of an environmental conditions.

5. A defrosting control system as set forth in claim 3 wherein said pulse selection means is provided with a means which ensures the transmission of the pulses from said frequency doubler to said electronic counter when a power source is thrown regardless of an environmental temperature.

6. A defrosting control system as set forth in claim 2 wherein there is provided a pulse selection means which transmits the pulses from said pulse source to said electronic counter when the environmental conditions are higher than predetermined values or which transmits the pulses from said frequency divider to said electronic counter when the environmental conditions are lower than said perdetermined values.

7. A defrosting control system as set forth in claim 3 wherein there is provided a pulse selection means which transmits the pulses from said pulse source to said electronic counter when an environmental temperature is higher than a predetermined level or which transmits the pulses to said electronic counter through said frequency doubler when an environmental temperature is lower than said predetermined level.

8. A defrosting control system for a heat pump which provides air conditioning in summer and heating in winter, said control system providing a relatively long evaporator defrost cycle in the summer and a relatively short evaporator defrost cycle in the winter, with the cycle intergration time varying in accordance with an environmental parameter, comprising:

means for providing first and second pulses having first and second respective substantially different frequencies;

means for counting said pulses, said counting means having a count limit;

means for generating a defrost signal each time the output of said counting means reaches said count limit;

means for coupling said first pulses to said counter when said environmental parameter has a value less than a given threshold value;

means for coupling said second pulses to said counting means when said environmental parameter has a value greater than said threshold value, and means responsive to said defrost signal for defrosting said evaporator.

9. A defrosting control system according to claim 8, wherein said environmental parameter is temperature.

10. A defrosting control system according to claim 8, wherein said environmental parameter is humidity.

11. A defrosting control system according to claim 8, 9 or 10, wherein the frequency of said second pulses is double that the frequency of said first pulses.

* * * * *

UNITED STATES PATENT AND TRADEMARK OFFICE

CERTIFICATE OF CORRECTION

PATENT NO. : 4,251,999

DATED : February 24, 1981

INVENTOR(S) : Yasuhiko Tanaka

It is certified that error appears in the above—identified patent and that said Letters Patent is hereby corrected as shown below:

Column 3, line 16: Delete "r" after "signal".

Column 5, line 29: "instacen" should read --instance--.

Column 7, line 12: Delete "a".

Column 8, line 62: "perdetermined" should read --predetermined--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*